United States Patent [19]

Manges

[11] Patent Number: 4,656,671

[45] Date of Patent: Apr. 14, 1987

[54] REUSABLE HEADBAND

[76] Inventor: Richlyn P. Manges, R.D. #1, Box 443, Monongahela, Pa. 15063

[21] Appl. No.: 695,525

[22] Filed: Jan. 28, 1985

[51] Int. Cl.[4] ..... A41D 13/00

[52] U.S. Cl. ..... 2/174; 2/DIG. 11; 131/9

[58] Field of Search ..... 2/174, 171, DIG. 11, 2/197, 243 R; 132/9, 46 R; 112/262.1, 265.1, 132, 121.27

[56] References Cited

U.S. PATENT DOCUMENTS

| | | | |
|---|---|---|---|
| 1,697,919 | 1/1929 | Knepper | 2/171 |
| 2,873,708 | 2/1959 | Boltach | 112/262.1 |
| 2,987,730 | 6/1961 | Walker | 2/174 |
| 3,050,071 | 8/1962 | Hall | 2/174 X |
| 4,368,545 | 1/1983 | Seidman | 2/174 |
| 4,441,214 | 4/1984 | Werner et al. | 2/174 |
| 4,521,922 | 6/1985 | Mitchell et al. | 2/171 |

FOREIGN PATENT DOCUMENTS

| | | | |
|---|---|---|---|
| 0848628 | 9/1960 | United Kingdom | 2/197 |

*Primary Examiner*—Peter Nerbun
*Attorney, Agent, or Firm*—William J. Ruano

[57] ABSTRACT

A reusable headband for protecting the wearer from eye injury when using permanent hair solution, generally referred to as a "perm" band. It comprises a strip of terry cloth which has been folded over a short central strip of elastic and sewed to such elastic while stretched, so that upon relaxation of the elastic strip, an accordion pleat will be provided to give elasticity to only the central portion of the terry cloth band. On opposite surfaces of the end portions of the band, strips of Velcro are provided for attaching the band to the head of the wearer.

1 Claim, 5 Drawing Figures

REUSABLE HEADBAND

This invention relates to a headband and, more particularly, to a reusable band for protecting the wearer's eyes from a permanent hair solution when being applied to the hair.

In the past, protective bands, or so-called "perm" bands, have been disposable, requiring the purchase of a new band for each application of permanent hair solution or neutralizer. The band has been uncomfortable to the wearer and the cost substantial in view of the single use of the band.

An object of the present invention is to provide a novel stretchable band that is reusable for protecting the eyes of the wearer from permanent hair solution or neutralizer that could cause injury thereto.

Other objects and advantages of the invention will become more apparent from the following description taken with the accompanying drawing wherein.

Figure 1:
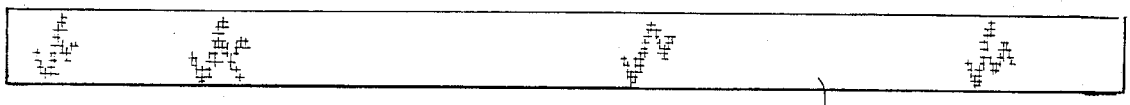
FIG. 1 is a strip of terry cloth constituting the first step in the construction of a protective headband embodying the present invention.

Referring more particularly to FIG. 1, numeral 1 denotes a strip of terry cloth or other absorbent material, preferably about 28" long and 2½" wide.

Figure 2:
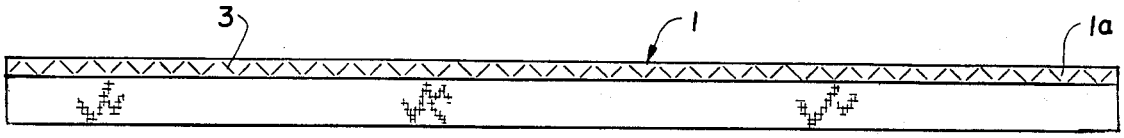
FIG. 2 shows a second step involving folding along the upper edge.

FIG. 2 shows the first step in the sewing of the protective band involving the folding over of the top edge 1*a*, which is ½" wide, and thereafter applying a zigzag stay stitch 3 along the entire length of the fold 1*a*.

Figure 3:
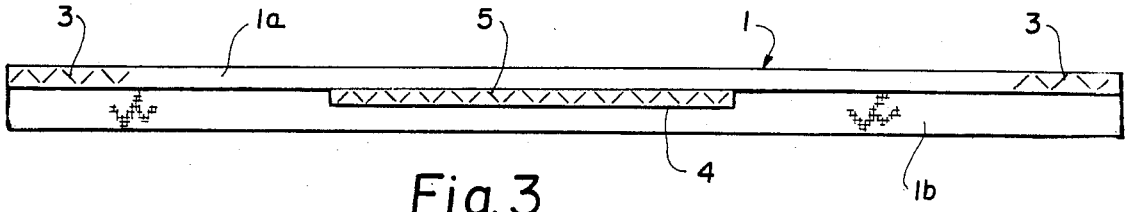
FIG. 3 shows a third step involving attaching an elastic band.

FIG. 3 shows the application of an elastic band 4 of about 5" long, which is pinned in the center and the elastic 4 stretched from one end to the other while it is being zigzag stitched at 5 to the strip.

Figure 4:
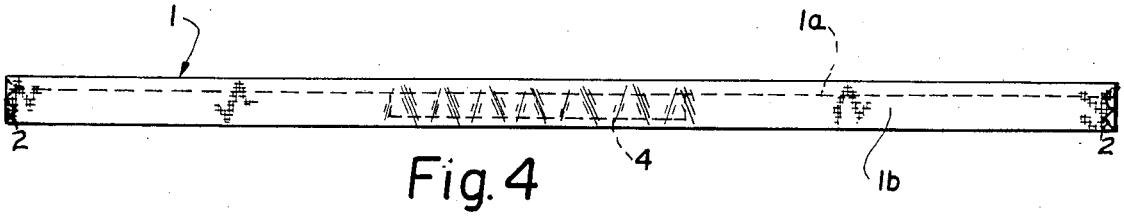
FIG. 4 shows a fourth step involving folding over the lower edge of the terry cloth band while the elastic band is still stretched and thereafter allowing the elastic band to relax and form a central accordion pleat to the strip.

FIG. 4 shows the lower edge folded over to abut the edge of folded portion 1*a* and sewn to strip 1 and to the elastic band 4 while stretched and zigzag stitched also at ends 2. When the ends of strip 1 are released of tension, according pleats will appear at the central portion as a result of relaxation of the elastic strip 4.

Figure 5:
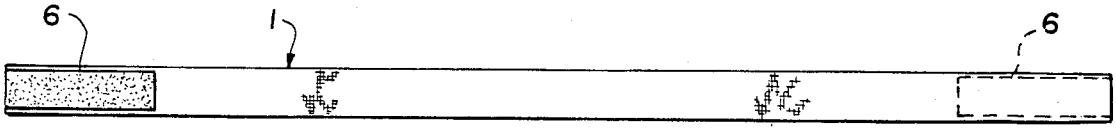
FIG. 5 shows the finished band with Velcro strips on the ends.

FIG. 5 shows the final construction embodying the sewing of fastening strips 6,6, on the ends of strip 1, one on one side and the other on the opposite side of the terry cloth strip 1, and preferably made of Velcro; namely, strips having upstanding stiff bristles which interlock when the bristles of strips 6,6 are placed together in engagement, thereby fastening the headband to the head of the wearer.

The construction shown in FIG. 5 makes the headband readily washable and therefore reusable many times, thereby greatly reducing the cost of the use of protective bands for the head.

It will be apparent that the present construction shown in FIG. 5 may be also used for ornamental headbands or sweatbands, but its main purpose is for cosmetology use as a "Perm" band.

Thus it will be seen that I have provided a highly efficient and reusable Perm band for protecting the eyes against the effects of permanent hair solution, or neutralizer, which headband has only a central elastic portion so as to provide greater comfort in wear and greater ease of application to the head of the wearer.

While I have illustrated and described a single specific embodiment of my invention, it will be understood that this is by way of illustration only and that various changes and modifications may be contemplated in my invention within the scope of the following claims:

I claim:

1. The method of making a reusable perm band of terry cloth comprising folding over one longitudinal edge of the Perm band and applying a zigzag stay stitch throughout the entire length of the longitudinal folded portion of said band while flat, pinning the center of an elastic strip of substantially shorter length than said band and stretching the ends of said elastic strip and, while stretched, zigzag stitching said elastic strip on the longitudinal central portion of said band, then folding over the other longitudinal edge over the elastic strip so as to abut said first-mentioned longitudinal edge and completely surround said elastic strip and zigzag sewing it to said elastic strip while stretched, and finally sewing hood and pile strips on the ends of the Perm band devoid of said elastic strip, but on opposite sides thereof.

* * * * *